United States Patent [19]

Starck et al.

[11] Patent Number: 4,581,902

[45] Date of Patent: Apr. 15, 1986

[54] COMBINATION STORAGE CONTAINER AND TABLE

[76] Inventors: Jane G. Starck, 6500 E. Maverick, Paradise Valley, Ariz. 85253; Norman Rosenblum; Frances C. Rosenblum, both of 12449 N. 80th Pl., Scottsdale, Ariz. 85026; James T. Misenhimer; Lynn W. Misenhimer, both of 8431 E. San Miguel Ave., Scottsdale, Ariz. 85253; Frederick B. Starck, 11815 N. 35th St., Phoenix, Ariz. 85028; Daniel Starck, 3528 E. Monica, Phoenix, Ariz. 85032; Catherine Starck, 11815 N. 35th St., Phoenix, Ariz. 85028; Monica C. Starck, 3528 E. Monica, Phoenix, Ariz. 85032

[21] Appl. No.: 642,482

[22] Filed: Aug. 20, 1984

[51] Int. Cl.[4] ..... F25D 23/13

[52] U.S. Cl. ..... 62/258; 62/457; 190/11; 312/241

[58] Field of Search ..... 62/457, 258, 464, 458; 312/241, 351; 190/11, 12 A

[56] References Cited

U.S. PATENT DOCUMENTS

| | | | |
|---|---|---|---|
| 592,159 | 10/1897 | Miller | 190/11 X |
| 2,093,856 | 9/1937 | Wales | 62/258 |
| 2,895,311 | 7/1959 | Spalvins | 62/258 |
| 3,347,060 | 10/1967 | Barkan | 62/457 |
| 4,436,353 | 3/1984 | Tucker | 312/241 |
| 4,515,421 | 5/1985 | Steffes | 62/457 |

*Primary Examiner*—Lloyd L. King
*Attorney, Agent, or Firm*—Gregory J. Nelson

[57] ABSTRACT

An improved portable cooler and auxiliary table is the subject of the present invention. The cooler includes an insulated container having an openable top to provide access to the cooler chamber. In one embodiment, an auxiliary top panel is provided with U-shaped brackets at opposite ends which are selectively securable in receivers at the opposite ends of the container to secure the top in a position immediately overlying the cooler cover for storage. To place the auxiliary table in an elevated position of use, the table is removed from the receivers and legs are foldable from a stored position to a position of use and engageable in the receivers to position the table at an elevation above and parallel to the cooler top to allow access to the cooler chamber. The table may also be removed for use independent of the cooler. In other embodiments, the legs are extendible from apertures in the cooler side or end walls to allow the table unit to be elevated to the desired position and then secured in place. In another embodiment, the support legs are pivotally secured to the end of the cooler between the storage position and a position of use. In the latter embodiment, the auxiliary table is selectively securable to the cooler top in the stored position so that access is provided to the cooler chamber in the storage position. Additional storage for food utensils and other items may be provided in drawers or recesses provided in the auxiliary table.

13 Claims, 32 Drawing Figures

70
76
6
78
72
3
102
104
105
81
74
5
82
6
16
80
100
90
95
83
92
5
40
95
14
94
52
60
12
70
90
72
18
90
105
105
10
3
20
4
80
40
52
14
54
12
50
56
4
10
18

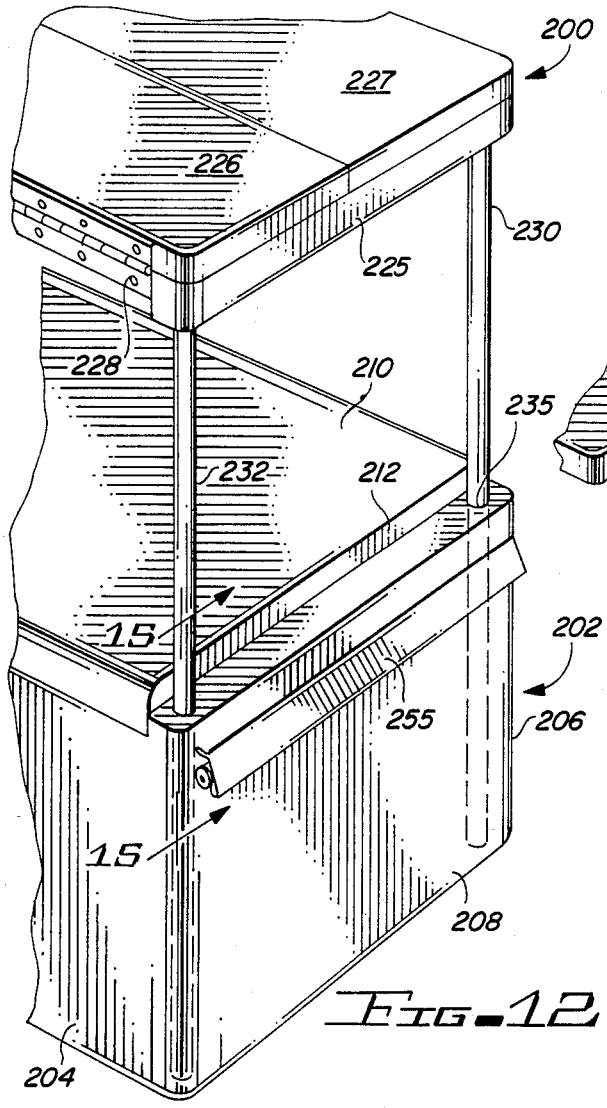
FIG. 12
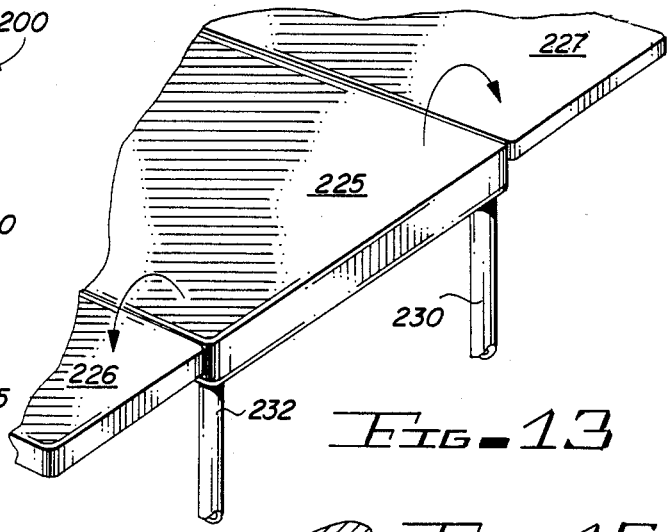
FIG. 13
FIG. 15
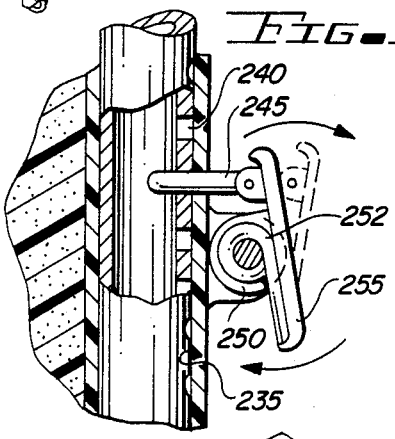
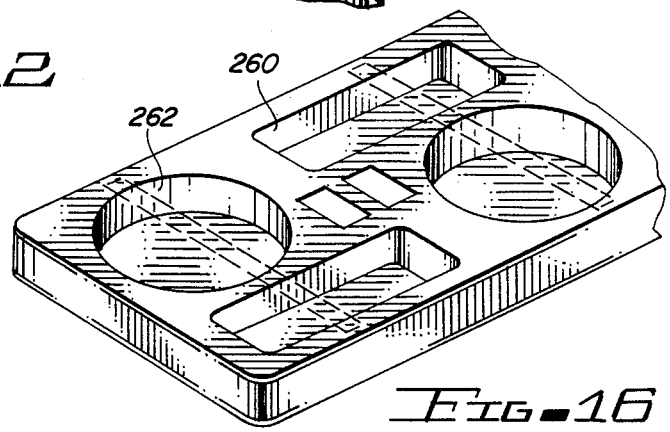
FIG. 16
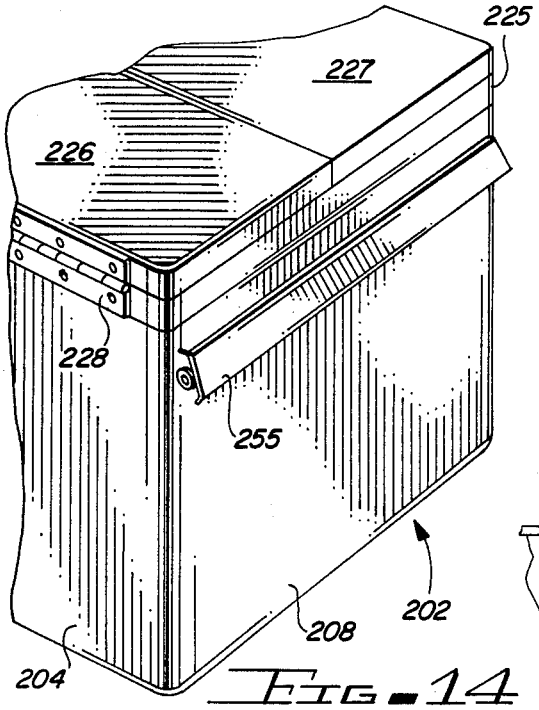
FIG. 14
FIG. 17
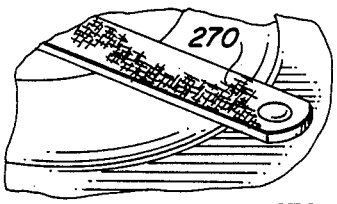
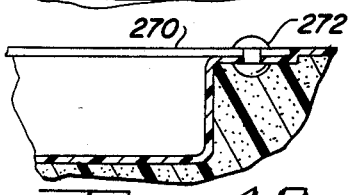
FIG. 18
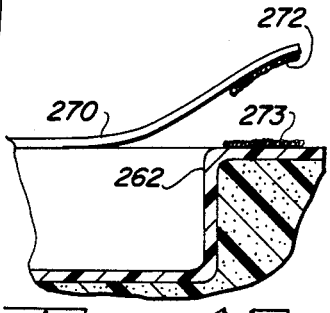
FIG. 19

COMBINATION STORAGE CONTAINER AND TABLE

The present invention relates to storage containers and more particularly to insulated containers having a removable lid for storing food and beverage items in a cool condition.

Insulated storage containers of the type commonly referred to as "ice chests" have come into wide use as a means for storing food, drink and other perishables for use on picnics, camping trips, fishing trips and other outings. The wide acceptance of these containers or ice chests is attributable to several factors including the availability of expanded plastic materials which provide superior insulating qualities at low weight and low cost. Generally these containers are rectangular having a removable top and including compartments for foods and an area to hold a cooling media such as ice or, in some cases, freezable containers which may be re-used.

One problem the user of ice chests often encounters is a lack of usable storage surface such as a table top for picnic items. The removable top on the container chest itself either lifts off or in some cases is pivotally attached to the ice chest and therefore is not a suitable storage surface since items must be removed from the surface prior to obtaining access to the ice chest compartment.

Accordingly, there exists a need in the art for an insulated container of the ice chest type having a removable top and which further provides convenient storage surface such as a table top which may be used independently of the lid of the container.

Briefly, in accordance with the present invention, an insulated container constructed of a suitable insulating material such as an expanded polyethylene and having a removable lid is provided. In the preferred embodiment, a table top is associated with the container which in the stored position rests on top of the container and is secured by brace members which snap into receivers located at each end of the ice chest. The table top is additionally equipped with U-shaped legs at either end which in the stored position fold and assume a position at the underside of the table top. When the table top is removed from the receivers, the longer U-shaped legs may be unfolded and snapped into the receivers to provide a horizontal table top or storage surface elevated above the lid of the container permitting the lid of the ice chest to be opened.

In other embodiments, the table top is supported on legs which are vertically extendable from channels or receptacles in the ice chest frame so that the storage surface may be elevated from the storage position to a use-position above the lid of the ice chest and locked in place. The table top may be further provided with trays or compartments for storage of items such as eating utensils. Additionally, straps or other fastening members may be provided on the sides of the ice chest for securement of auxiliary items as required.

The above and other objects and advantages of the present invention will become more apparent from the following description, claims and drawings in which:

FIG. 12 is a partial perspective view of yet another embodiment of the present invention;

FIG. 13 is a partial perspective view illustrating the auxiliary table top shown in FIG. 12 in an unfolded position;

FIG. 14 is a partial perspective view showing the auxiliary table top in a stored position;

FIG. 15 is a sectional view taken along lines 15—15 of FIG. 12;

FIG. 16 is a perspective view illustrating the bottom side of the auxiliary table;

FIG. 17 is a partial detail view illustrating one of the storage compartments shown in FIG. 16;

FIGS. 18 and 19 are cross-sectional detail views of a portion of the storage compartment shown in FIG. 16;

Figure 3:
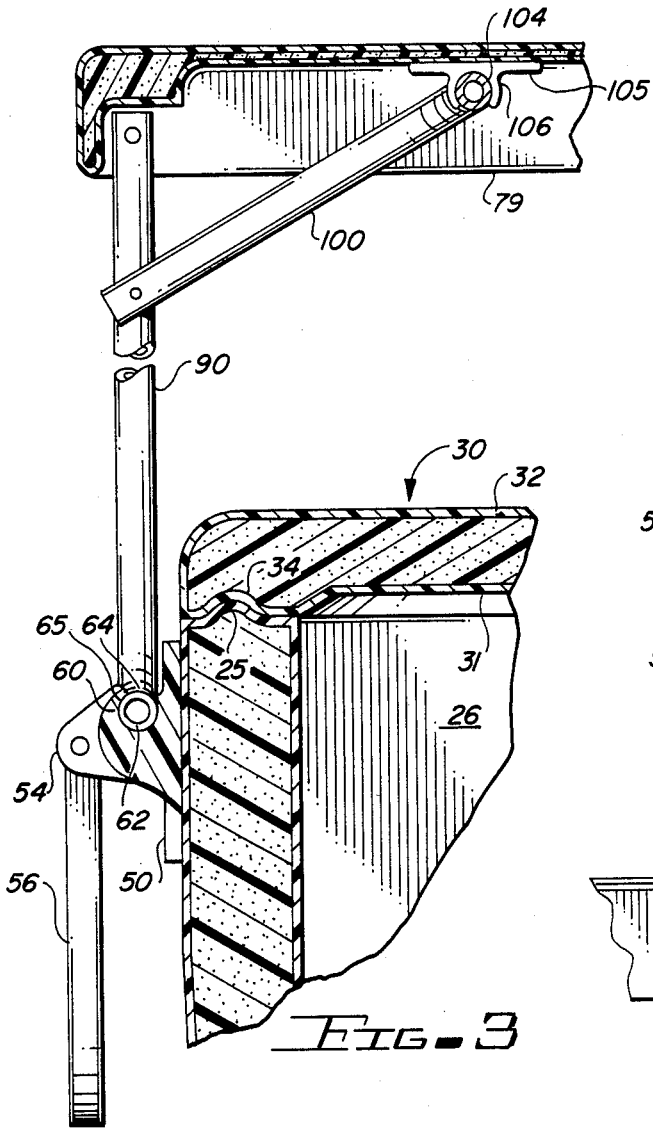
FIG. 3 is a sectional view taken along lines 3—3 of FIG. 1.

Referring now to the drawings, particularly FIGS. 1 through 6, the insulated container of the present invention is generally represented by the numeral 10 and is rectangular in construction having opposite side walls 12 and 14, end walls 16 and 18, and bottom 20 defining compartment 26. The walls are preferably constructed from a high strength material such as polyethylene having an outer shell and an inner liner with the area between the outer shell and inner lining filled with an appropriate insulating material such as an expanded polyethylene foam. As best seen in FIG. 3, the upper edge of the end and side walls is formed having a convex rib 25 extending around the compartment 26 defined by the side walls. A cover 30 has inner wall 31 and outer wall 32 spaced apart with the area therebetween filled with a suitable insulating material. The cover 30 is formed having a recessed lip 34 cooperating with the peripheral rib 25 on the end and side walls in the closed position. The cover is secured by closure 40 in the closed position and lifts off the container portion or is pivotal at hinges, not shown, to an open position to provide access to the interior compartment 26. The foregoing construction is generally well known and is conventional in the art.

Figures 1, 2:
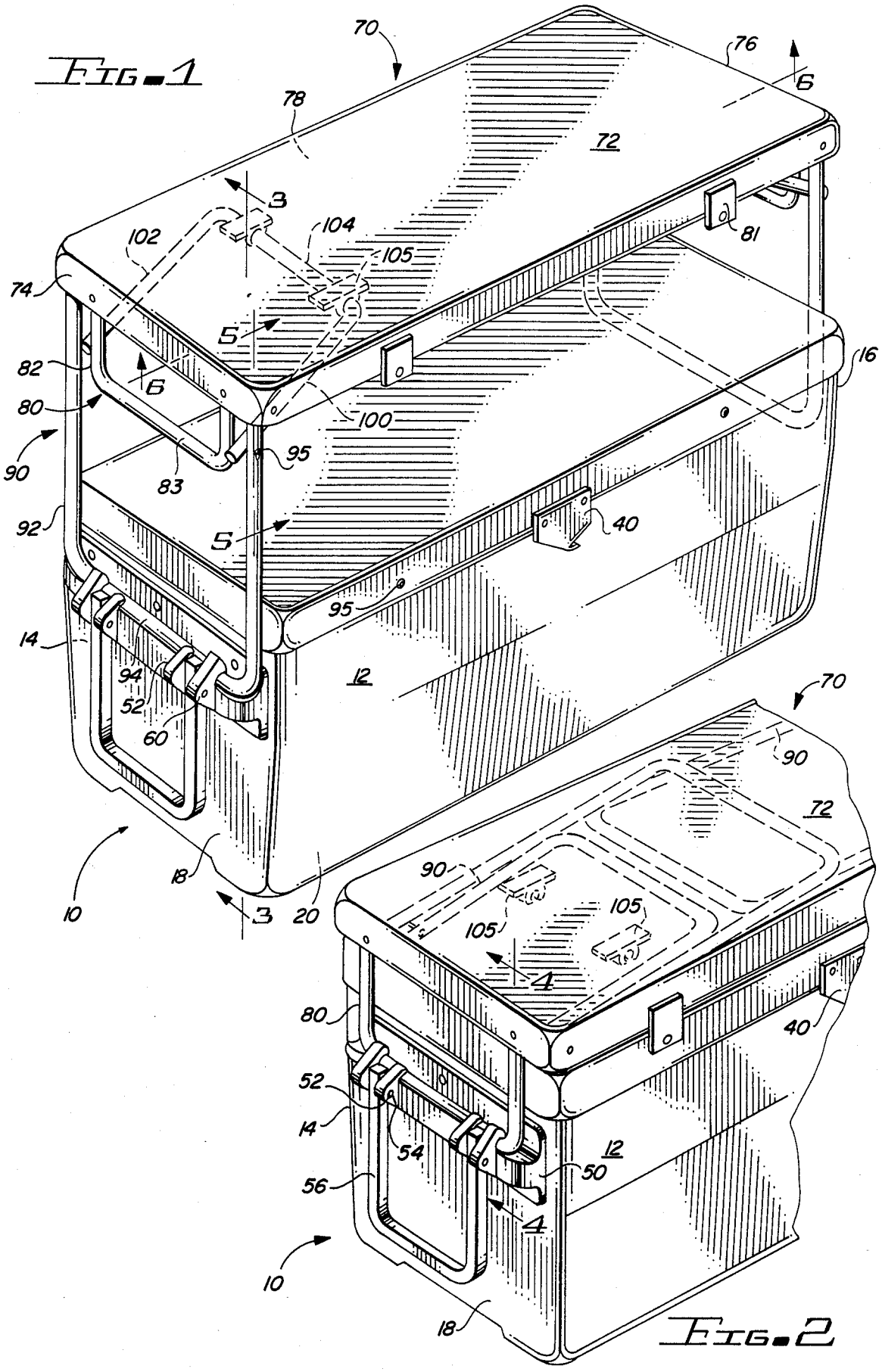
FIG. 1 is a perspective view of an insulated container according to a preferred embodiment of the present invention showing the auxiliary storage table in a raised position.
FIG. 2 is a partial perspective view similar to FIG. 1 with the auxiliary table top in a stored position.

A plate 50 extends horizontally across the opposite end walls 16 and 18. Each of the plates 50 has a pair of spaced-apart hinges 54 which pivotally support U-shaped handle 56 at hinge pins 52. In the normal position, the handles 56 assume a position as shown in FIGS. 1 and 2 with the handle lying adjacent the end walls. When the handles are grasped by the user, they may be pivoted 180° to a convenient position for lifting or carrying the container.

Figure 4:
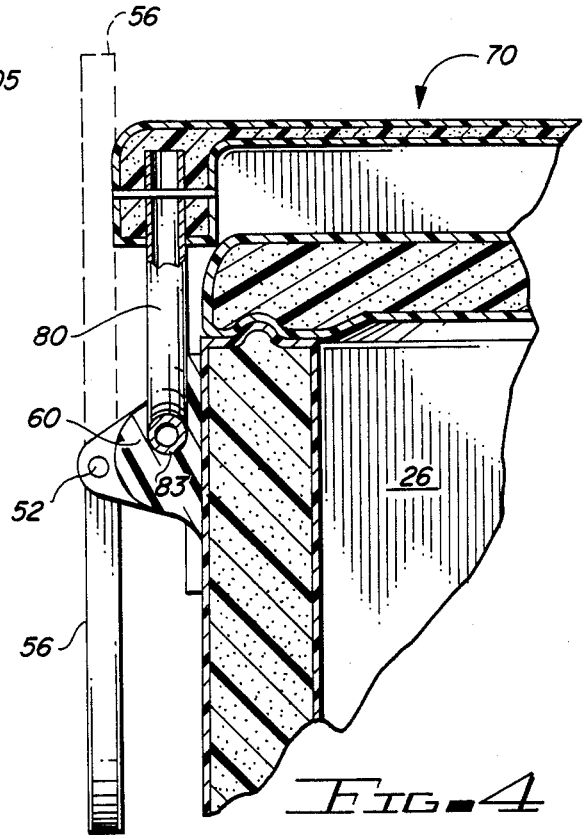
FIG. 4 is a sectional view taken along lines 4—4 of FIG. 2.
Figure 5:
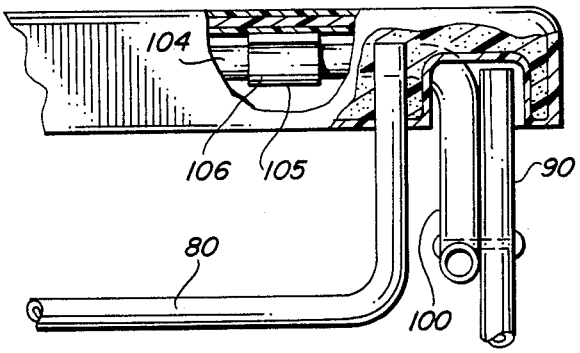
FIG. 5 is a sectional view taken along lines 5—5 of FIG. 1.

As best seen in FIGS. 3 and 4, receiver members 60 are spaced-apart on plate 50 at the outside of the hinges 54. Each of the receivers 60 are integrally formed with plate 50 defining a generally semi-circular cut-out 62 which opens upwardly at 64. A portion of the receiver defines a lip 65 which extends into the opening 64 so that the width of the opening 64 is slightly less than the diameter of the semi-circular cut-out 62. The receiver 60 is preferably molded of a durable, resilient plastic to engage the table support members as will be explained hereafter.

The auxiliary table assembly 70 includes a planar, generally rectangular surface 72, opposite ends 74, 76 and opposite sides 78, 80. The size and shape of the surface 72 generally conforms to that of the container. A peripheral edge 79 extends around the top 72 so the underside of table surface 72 is recessed as best seen in FIGS. 3 and 4.

A pair of U-shaped mounting members 80 having vertically extending leg members 82 and horizontal cross member 83 are rigidly secured at the opposite ends 74 and 76 of the table. The mounting member 80 is configured so that the cross member 83 will securely engage receiver 60 with the table surface 72 resting on the upper surface of the ice chest cover member 30. As pointed out above, the receiver 60 is provided with an aperture 62 which closely conforms to the configuration of the cross members 83 so that the table may be releasably positioned against the container cover with the mounting members in a locked position in the receiver 60.

In order to position the table 70 at a higher elevation and in a more convenient position of use so that access to the subjacent ice chest chamber 26 is available, a pair of folding support members 90 are positioned at either end of the table unit. The support members 90 consist of a pair of vertically extending legs 92 joined at their lower end by a cross piece 94. The upper ends of legs 92 are secured by pivot pin 95 to the lower end of U-shaped brace member 100. Brace member 100 has a pair of oppositely spaced, parallel legs 102 joined by cross member 104. A pair of retaining clip members 105 are mounted on the underside of the table spaced inwardly from each end a predetermined distance. The clip members 105, as best seen in FIG. 3, have a pair of downwardly depending legs 106 defining a generally C-shaped opening 108 adapted to tightly receive cross-member 104.

In the raised position of use shown in FIG. 1, cross member 104 of the brace assemblies are engaged in the clip members 105 at either end of the table. This secures the supporting legs 90 in a vertical position so that cross member 94 may be engaged in receiver 60 at either end of the chest. In this position, the table surface 72 is elevated a sufficient distance above the ice chest so that cover 30 may be lifted away or pivoted to an open position to provide access to the the contents of chamber 26.

Figure 6:
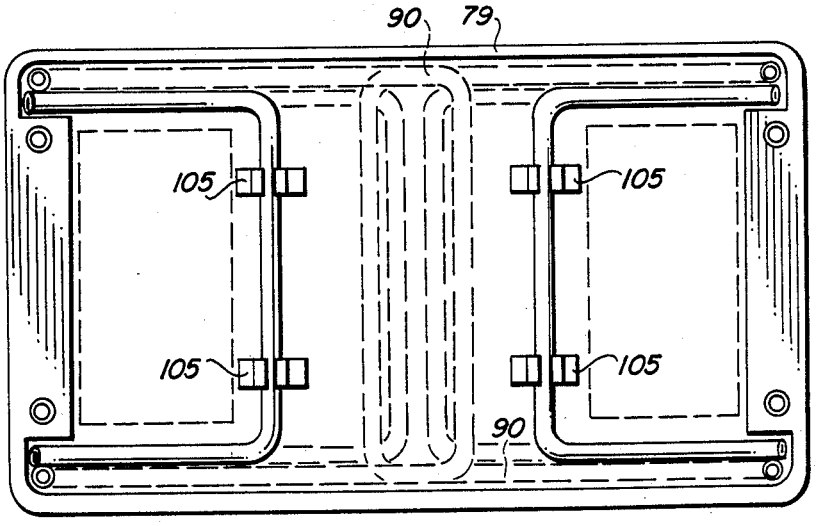
FIG. 6 is a bottom plan view of the auxiliary table top showing the legs in a folded position.
Figure 7:
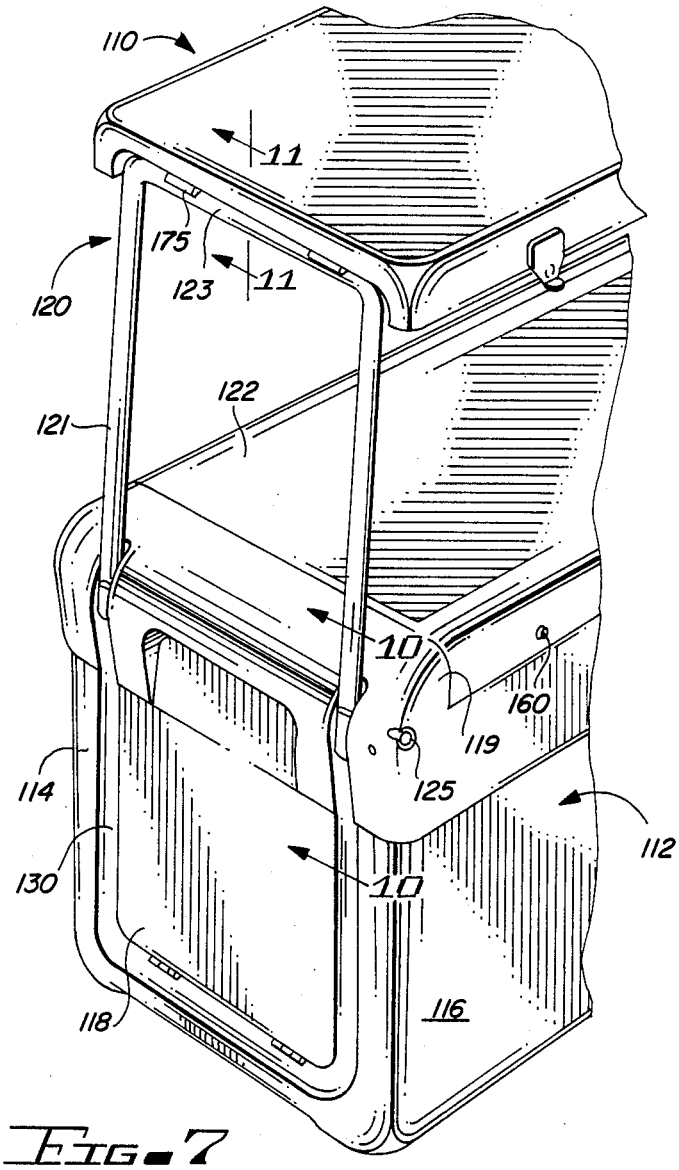
FIGS. 7 and 8 are partial perspective views showing an alternate embodiment of the present invention with the auxiliary top in the raised and stored positions respectively.

When it is desired to place table 70 in its folded position on the ice chest, cross pieces 104 at the opposite brace assemblies are removed from clips 105 by applying a downward force to spread the opposite ends of the C-shaped legs 106. When the brace 100 is free of the clips, legs 90 may be inwardly folded assuming a position at the underside of the table 72 within the general confines of ends 74 and 76 and opposite sides 78 and 81 as best seen in FIGS. 3 and 6. Members 80 are securable in receivers 60 at the ends of the ice chest. In this position, the table occupies little additional space beyond the dimensions of the ice chest and the ice chest can easily be transported with the accompanying auxiliary table unit. It will further be appreciated that in the raised position of use, the contents of the ice chest are readily available to the user and the user has a convenient table surface at a convenient height for use. Of course, the surface provided by the cover of the ice chest may also be used for storage and receipt of items when the auxiliary table 70 is in the raised position. The table 70 may also be utilized independent of the container 10 with the legs 90 in the erected position or as a lower table by using supports 80 as the legs.

Clips 91 on the sides 78 and 81 of the table may be included which cooperate with holes 95 to secure the container top and table as a unit so that the table and container top may be opened or stowed together.

Turning now to FIGS. 7 through 11, another embodiment of the present invention is shown generally designated by the numeral 110. Embodiment 110 includes a generally rectangular container 112 for the containment of food and other items. Container 112 is again provided with opposite side walls 114, 116 with end walls 118 at opposite ends of the chest. The upper edge of end walls 118 and opposite side walls 114 define a shoulder 119 for receipt of a flush-mounted cover 122 which may be lifted from the chest container 112 or pivoted to an open position to provide access to the contents of the container. Again, the cover and the container are constructed from suitable synthetic materials such as a sandwich construction having an outer and inner polyethylene wall spaced apart by a suitable insulating material such as expanded polyurethane.

Figure 8:
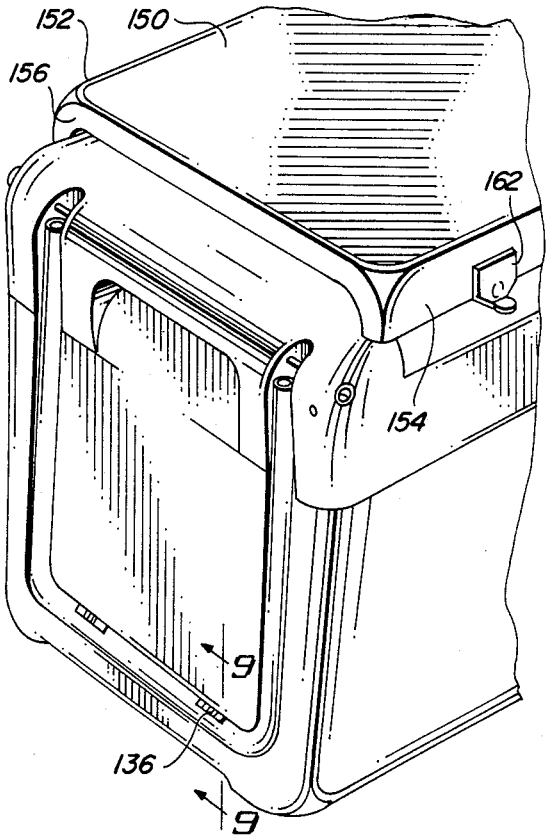
Figure 9:
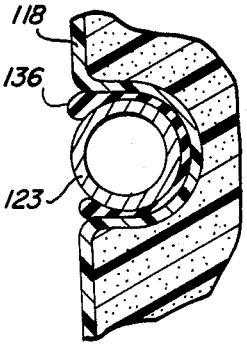
FIG. 9 is a sectional view taken along lines 9—9 of FIG. 8.

A pair of generally U-shaped support members 120 are provided at opposite end walls 118. The U-shaped support members have a pair of spaced-apart vertical leg members 121 joined by a cross member 123. The upper ends of legs 121 are pivotally connected to the end walls at pivot pin 125. Preferably, the end walls 118 are each provided with a recess 130 having a configuration conforming to that of the U-shaped supports 120 so that the supports 120 may be pivoted to an out-of-the-way stored position as seen in FIG. 8. Preferably the horizontal sections of the recesses 130 are each provided with flexible retaining members 136 which serve to frictionally secure the member 120 in the stored position by engaging cross piece 123 as seen in FIG. 9.

The auxiliary table top 150 is generally rectangular having side edges 152, 154 and opposite ends 156. The size and configuration of the auxiliary table 150 generally corresponds to that of the cover 122 of the ice chest. One or more female fastener members 160 are provided along the vertical edge of cover member 122. Cooperating male fastener members 162 are carried on the vertical sides 152 and 154 of the auxiliary table 150. Thus, in the stored position, the cover 122 of the ice chest and the auxiliary table can be engaged as a unitary structure so that the ice chest cover 122 and the accompanying table 150 may be opened as a unit to provide access to the interior chamber.

Figure 10:
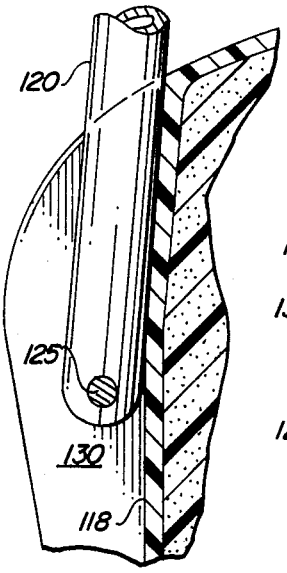
FIG. 10 is a sectional view taken along lines 10—10 of FIG. 7.
Figure 11:
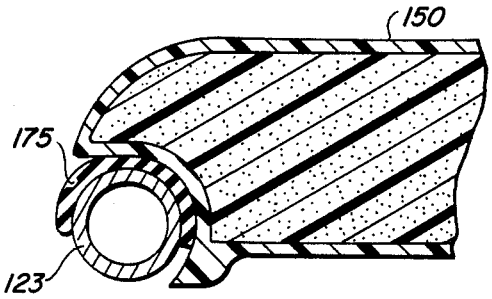
FIG. 11 is a sectional view taken along lines 11—11 of FIG. 7.

In order to place the auxiliary table surface 150 in a position of use, a pair of retaining clips 175 are provided at the opposite ends of the table. Clips 175, as best seen in FIG. 11, are generally C-shaped having a major diameter conforming to the diameter of the tubular material of the cross piece 123. With leg assembly 120 pivoted to the position shown in FIG. 7, cross piece 123 can be engaged by the retaining clip members 175 to secure the auxiliary table surface 150 in an elevated position. The leg assembly 120 is slightly over center as shown in FIG. 10 so it remains in a rigid position for use. In this position, the lower cover 122 of the ice chest can be opened without interfering with the use of the table 150 in the raised position.

Still another embodiment of the invention is illustrated in FIGS. 12 through 19 and is generally designated by the numeral 200. Embodiment 200 includes a generally rectangular container 202 having opposite side walls 204 and 206 and end walls 208. The cover 210 completes the enclosure and is removable to provide access to the interior chamber of the container or ice chest. Cover 210 is shown as being generally rectangular and having an end wall 212 terminating at a location inward of end wall 208 so that the upper edge of the end wall 208 is exposed. Again, the construction of the cover and receptacle is of a relatively rigid, high strength material such as polyethylene with an inner and outer wall integrally formed with the area between the two walls being filled with an insulating material such as an expanded polyurethane foam.

The auxiliary table includes a generally rectangular table section 225 generally corresponding in size to the top of the subjacent container 202. A pair of leaves 226 and 227 are pivotally secured to the opposite side edges of section 225 by piano hinge 228. Each of the leaves 226 and 227 have a width approximately half of that of 225 so that in the folded position, the outer edges of the leaves 226 and 227 abut and overlay section 225 as best seen in FIG. 12.

A pair of legs 230 and 232 extend vertically from the underside of table section 225 at each corner of the section. The legs 230 and 232 are received in vertically extending channels 235 at opposite sides of end wall 208. Thus, the auxiliary table assembly, including the main section 225 and leaves 226, 227 can be positioned in a stored position as shown in FIG. 14 immediately engaging cover 210 or can be raised to an elevated position as shown in FIG. 12.

To lock the auxiliary table in the elevated position, each of the legs 230 and 232 is provided with a series of vertically spaced apart apertures 240 as shown in FIG. 15. A detent pin 245 is aligned with each of the legs 230 and 232 and is mounted on bracket 250 extending transversely at either end 208. Detent pin 245 is inwardly biased by spring 252. A cover 255 extends transversely between the spring members at either side of the chest. It will be apparent that by applying a force at the lower end of cover 255 in the direction of the arrow, the detent pin will be caused to withdraw from the associated aperture 240 in the legs 230 and 232. This will allow the user to elevate the table structure or return the table to the lowered storage position shown in FIG. 14.

Additional table space can be provided by elevating the table to the position of use shown in FIG. 12 and further usable space provided by pivoting the opposite leaves 226 and 227 outwardly. In this elevated position, the contents of the container are easily and conveniently accessible by removal of cover 210.

To provide additional storage, the underside of table section 225, as best seen in FIGS. 16 and 19, may be provided with a plurality of generally rectangular depressions 260 or circular recesses 262. Circular recesses 262 are designed to accommodate such items as plates which will be held in position by a strap 270 extending transversely across the depression. Strap 270 can easily be secured in place by anchor 272 with strap 270 being elastic to permit the dishes to be inserted in the depression. An alternative method of securing the strap is shown in FIG. 19 in which the strap 270 is non-elastic and is provided with one portion of a loop and hook fastener 272 to its outer end. The mating portion of the loop and hook fastener 273 is provided adjacent the depression 262 or 260.

Still another embodiment of the present invention is illustrated in FIGS. 20 through 25 and is generally designated by the numeral 300. Again, insulated container 302 is generally rectangular having opposite side walls 304 and 306, end walls 308 which together with a bottom, not seen, define an interior chamber for containment of perishable items. Cover 310 is removable from the receptacle to provide access to the interior chamber. A recess 312 is provided in the opposite end walls 308 to provide a handle by which the receptacle may be lifted or transported.

Figure 20:
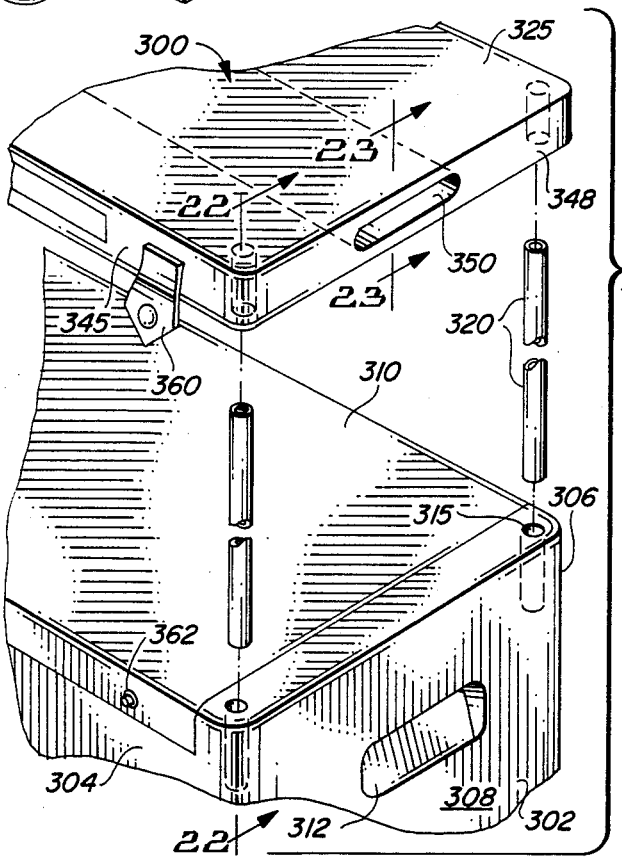
FIG. 20 is a partial perspective view showing still another embodiment of the present invention.
Figure 23:
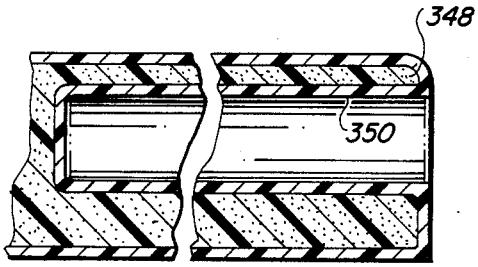
FIG. 23 is a sectional view taken along lines 23—23 of FIG. 20.

The opposite end walls 308 are provided with a pair of vertical bores 315 adjacent each of the corners of the end wall. The bores 315 slidably receive leg members 320 as best seen in FIG. 20. When inserted the legs 320 provide support for the auxiliary table 325.

Figure 21:
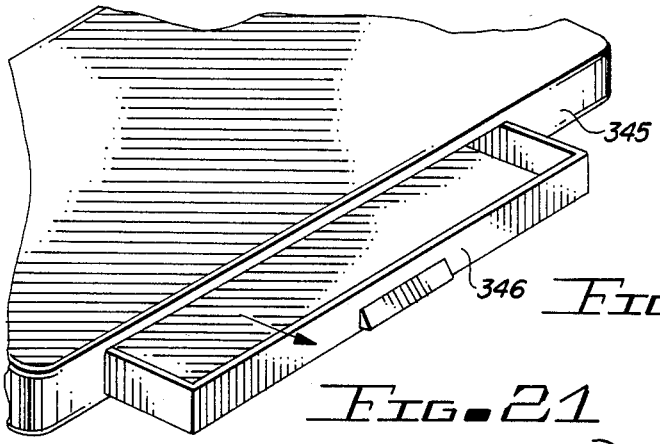
FIG. 21 is a partial perspective side view of the table of FIG. 20 showing a storage drawer therein.
Figure 22:
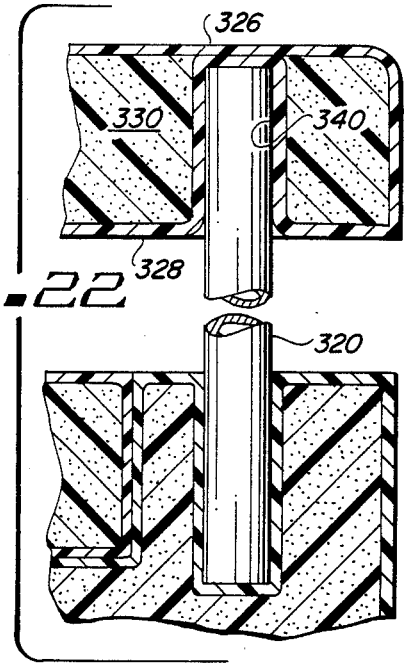
FIG. 22 is a sectional view taken along lines 22—22 of FIG. 20.

Table 325, as seen in FIG. 22, is constructed having an upper surface 326 and a lower surface 328 spaced apart with the area between filled with a suitable insulating material 330. Recesses 340 are provided at the corners of the table at a location corresponding to the location of recesses 315 in the container. Upper end of legs 320 are snugly received within recesses 340 as best shown in FIG. 22. Thus, to position the auxiliary table surface 325 in a position of use, the support legs 320 are each placed in a corresponding recess 315 in the container and the table surface 325 positioned on the upper ends of the supports at recess 340. As seen in FIG. 21, the side edge 345 of the table top slidingly receives a drawer 346 for convenient storage of utensils and accessories.

A longitudinally extending storage compartment 350 is provided in table 325 opening at end 348. In the stored position, the legs 320 are removed from recesses in the receptacle and table top and may be stored in the compartment 350. The auxiliary table top 325 may be conveniently secured to the cover 310 of the chest by fastener members 360 engageable and cooperating members 362 carried on the sides of the cover 310. In the stored position, the cover may be open to provide access to the enclosed chamber 375.

Figure 24:
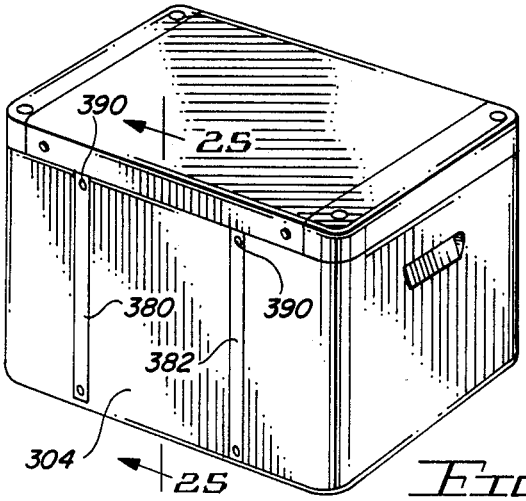
FIG. 24 is a perspective view of the embodiment of the ice chest shown in FIGS. 20 through 23 with the table shown in a removed position.
Figure 25:
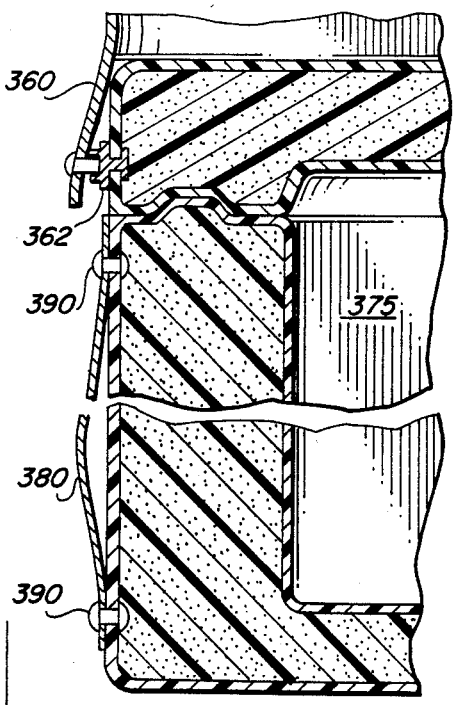
FIG. 25 is a sectional view taken along lines 25—25 of FIG. 24.
Figure 26:
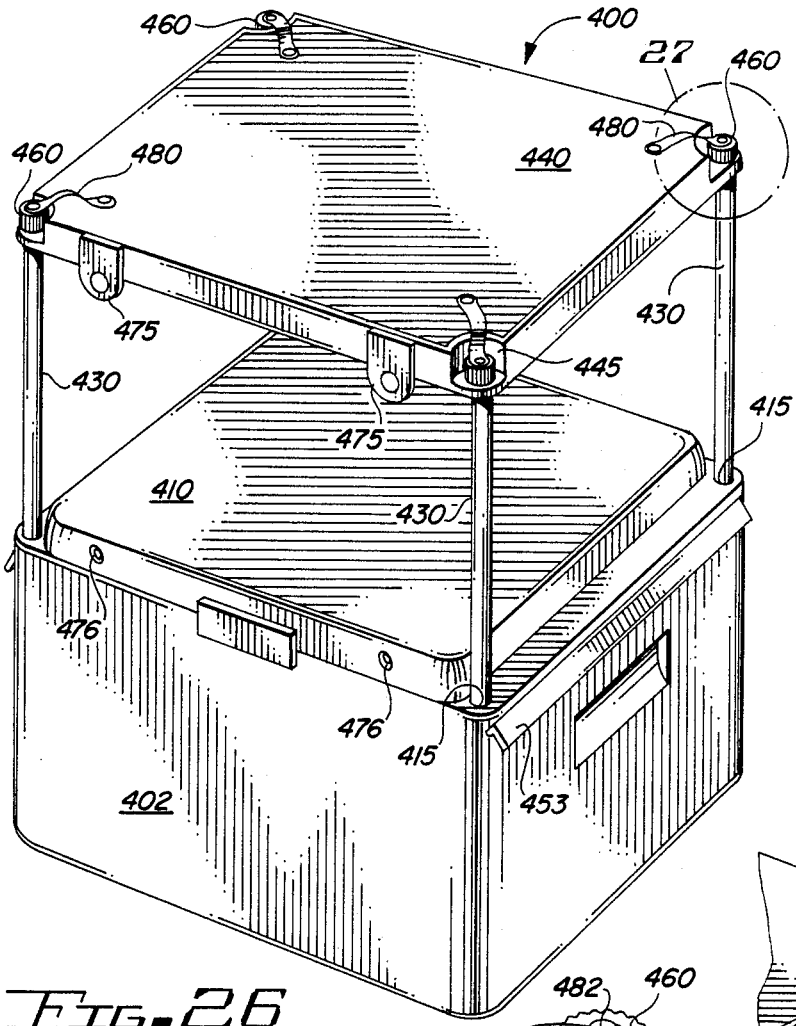
FIG. 26 is a perspective view of still another embodiment of the present invention showing the auxiliary storage table in a raised position.
Figure 27:
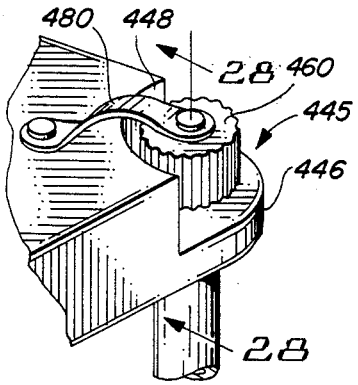
FIG. 27 is a detail view of a corner portion of the table as indicated in FIG. 26.
Figure 28:
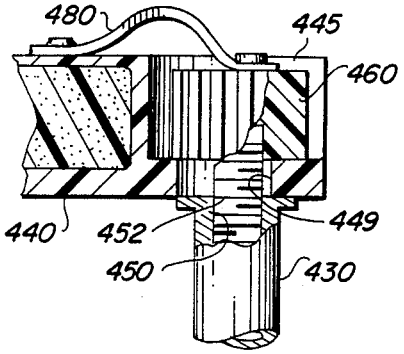
FIG. 28 is a cross-sectional view taken along lines 28—28 of FIG. 27.
Figure 31:
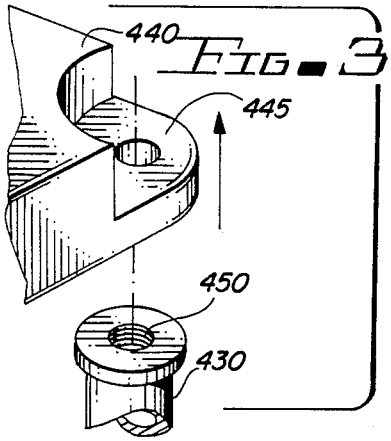
FIG. 31 is a view similar to FIG. 30 showing the table top disengaged from the table leg.
Figure 30:
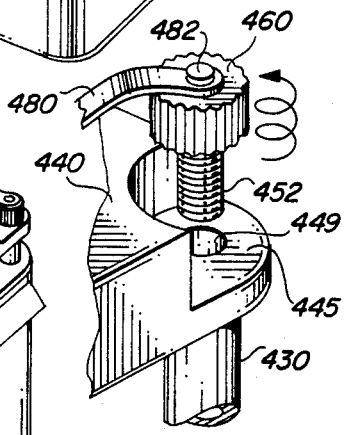
FIG. 30 is a detail view similar to FIG. 27 with the fastener in the loosened position.
Figure 29:
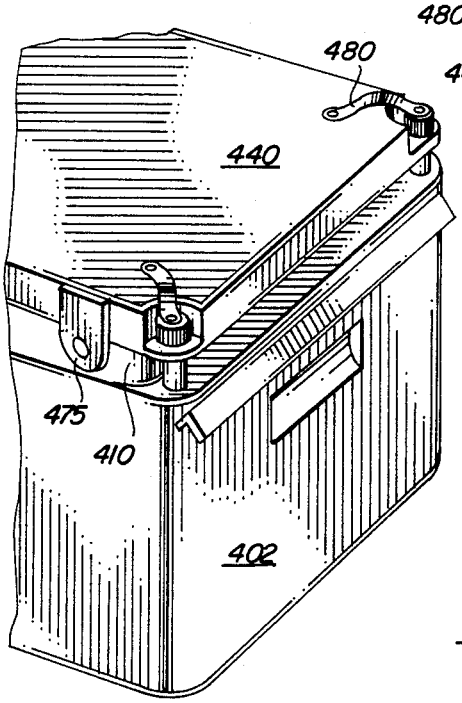
FIG. 29 is a partial perspective view of the embodiment of the ice chest shown in FIGS. 26 through 28 with the table in the stored position.

Additional storage for accessories may be provided at the side 304 of the container by means of vertically extending straps 380 and 382 which are appropriately secured to the outer shell by rivets 390 as best seen in FIGS. 24 and 25. Straps 380, 382 are preferably elastic so that items such as beach chairs and the like can be secured at the side of the container and transported with the container to the beach, picnic area or other area of use.

Another embodiment of the present invention generally designated by the numeral 400 is shown on FIGS. 26 through 32. In this embodiment, the container 402 is constructed in a manner similar to embodiment 200 illustrated in FIG. 12 having corner supports 430 vertically extensible within bores 415 in the container end walls. Detent actuating member 453 cooperates with a detent and apertures axially spaced apart in the supports 430 to secure the supports at the desired elevation. In this respect the construction, as mentioned above, is similar to that shown in previous embodiments and repetitive detailed description is not deemed necessary.

In the embodiment 400, the table 440 is provided with recesses 445 at the corners of the table leaving a thinner corner section 446. Corner section 446 defines an opening 448 which is aligned with each of the supports 430. The upper end of supports 430 are internally threaded at 450. Threaded sections 450 are adapted to be engaged by cap 460 which has threaded section 452. With cap 460 engaged, table 440 is secured in place. Cap 460 may be removed which will allow the auxiliary table 440 to be removed with the cover 410 of the container. Auxiliary table 440 and the cover 410 are attachable by appropriate cooperating fastener member 475 which engages cooperating member 476 at the side of the cover 410.

Figure 32:
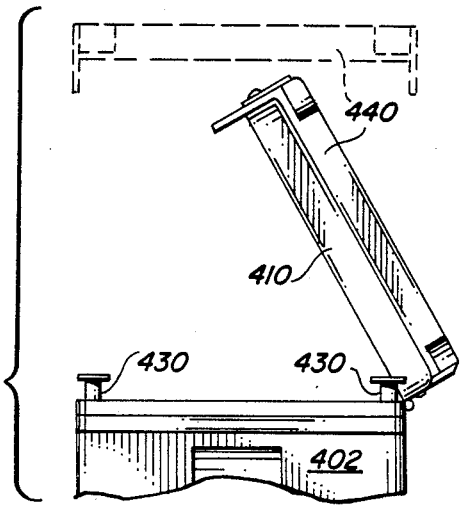
FIG. 32 is an end view illustrating the ice chest in an open position with the auxiliary table top in the stored position.

Fastener cap 460 is preferably secured to auxiliary table 440 by a flexible hinge member 480 one end of which attaches to the table and the other end secured at a rivet 482 to allow the cap to freely turn but yet prevent it from becoming separated. Openings 448 may be slightly elongated to facilitate easy securement since the lid pivots to an open position as shown in FIG. 32. Note the auxiliary table and the cover 410 can be secured as a unit and with caps 460 removed, access is provided to the interior of the compartment. When it is desired to put the auxiliary table in use, the auxiliary table 440 is attached at the upper ends of the support rods 430 by caps 460. Fasteners 475 at the edge of the auxiliary table 440 are unfastened and the table may be raised to the desired position and secured by detent mechanism.

Thus, it will be seen that the present invention provides a economical, compact and highly versatile combination container and table. The table can be conveniently put into a position of use or stored in an out-of-the-way position when not being used and still provide easy, convenient access to the container. The invention has been shown and described with reference to a cold storage chest or an ice chest. However, it will be obvious to those skilled in the art to apply the teachings herein to other types of containers.

To the extent these modifications, variations and improvements do not depart from the spirit and scope of the appended claims, they are intended to be encompassed therein.

We claim:

1. An improved portable cooler comprising:

(a) an insulated container having an openable top;

(b) an auxiliary table associated with said container having a surface, said table being removable from said container;

(c) support legs extending between said container and said table in a first position of use supporting said table at an elevated position above said container top and substantially parallel thereto with said container top being openable independently of said table at least in said position of use;

(d) said legs having a second out-of-the-way storage position with the said table occupying a position engaging said cooler top.

2. The cooler of claim 1 further including means for securing said table to said cooler top in said storage position.

3. The cooler of claim 2 wherein said cooler is generally rectangular having opposite sides and opposite ends, said ends each having a receiver for detachably securing a portion of said legs and wherein said table carries means cooperable with said receiver to secure said table in said storage position.

4. The cooler of claim 1 wherein said support legs are extendible from bores in said container between said storage and use positions.

5. The cooler of claim 4 further including detent means for securing said legs in said use position.

6. The cooler of claim 1 wherein said support legs are generally U-shaped and are pivotally secured to said container to pivot between said use and storage position.

7. The cooler of claim 6 wherein said container is generally rectangular having opposite ends and opposite sides and said legs are secured at the opposite ends, said ends each having a recess therein to receive said legs in said storage position.

8. The cooler of claim 1 wherein said legs are receivable in recesses in said container and in said table, said legs being removable therefrom in said storage position, said table including a storage compartment for receiving said legs in said storage position.

9. The cooler of claims 3, 4 or 6 wherein said table is generally rectangular having opposite ends and sides and including an extendible leaf hinged to at least one of said sides.

10. The cooler of claims 3, 4 or 6 further including storage means associated with said table.

11. The cooler of claims 3, 4 or 6 further including retainer means associated with said container for attachment and storage of items.

12. The cooler of claims 1, 5 or 8 wherein said table and legs are removable from said cooler and useable as an independent free-standing table.

13. An improved portable cooler comprising:

(a) an insulated container having an openable top;

(b) an auxiliary table associated with said container having a surface;

(c) generally U-shaped support legs extending between said container and said table in a first position of use supporting said table at an elevated position above said container top and substantially parallel thereto; and (d) said legs having a second out-of-the-way storage position occupying a position adjacent the underside of said table with the said table occupying a position immediately adjacent said cooler top.

* * * * *